United States Patent [19]

Cuckler et al.

[11] 3,946,391

[45] Mar. 23, 1976

[54] BUOY ANTENNA SYSTEM

[75] Inventors: Virgil A. Cuckler, Scottsdale; Russell R. Yost, Jr., Phoenix, both of Ariz.

[73] Assignee: Motorola, Inc., Chicago, Ill.

[22] Filed: Aug. 1, 1974

[21] Appl. No.: 493,578

[52] U.S. Cl. ..... 343/709; 343/792

[51] Int. Cl.[2] ..... H01Q 1/34

[58] Field of Search ..... 343/709, 710, 895, 792

[56] References Cited

UNITED STATES PATENTS

| | | | |
|---|---|---|---|
| 2,850,732 | 9/1958 | Kandoian et al. | 343/752 |
| 3,095,568 | 6/1963 | Aine et al. | 343/709 |
| 3,234,503 | 2/1966 | Wojciechowski et al. | 343/709 |
| 3,852,756 | 12/1974 | Reese | 343/895 |

*Primary Examiner*—Eli Lieberman
*Attorney, Agent, or Firm*—Michael D. Bingham; Maurice J. Jones; Harry M. Weiss

[57] ABSTRACT

An antenna system is disclosed that is suitable for use in the transmission of communication signals from expendable marker buoys. The antenna system is designed such that the antenna is interiorly disposed within the buoy, which eliminates the need for antenna seals and antenna automatic extension mechanisms.

The antenna is top loaded to permit the use of a relatively short vertical section. The antenna is attached to a ground plane skirt which is capacitively coupled through a dielectric form for establishing good radio frequency (RF) connection to the water surface within which the antenna system operates. The dielectric medium is provided by the outer housing of the buoy and hence the water surface becomes the effective ground plane for the antenna. In this manner, therefore, the antenna system does not require components to be extended beyond the interior of the buoy housing.

4 Claims, 1 Drawing Figure

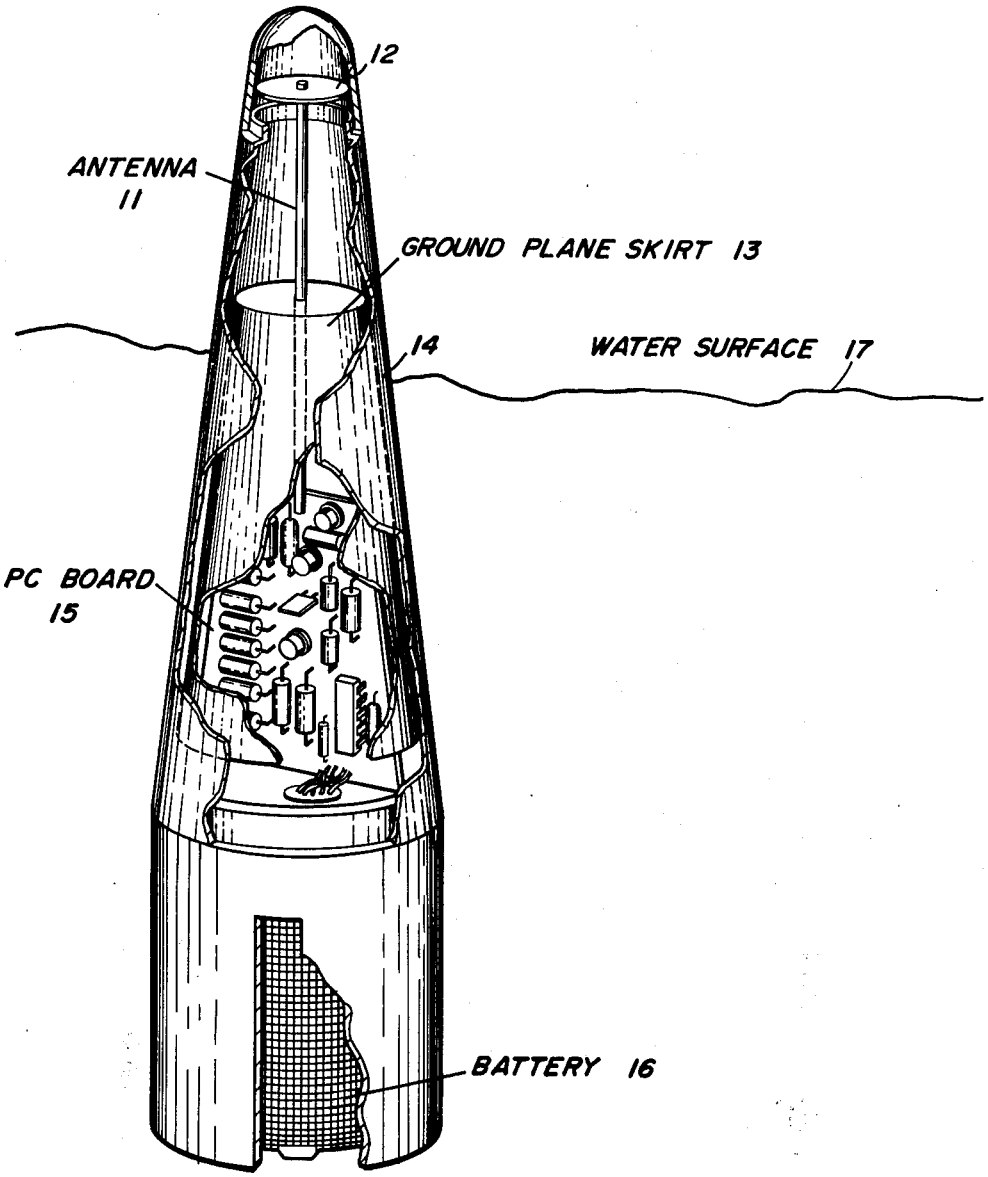
12
ANTENNA
11
GROUND PLANE SKIRT 13
14
WATER SURFACE 17
PC BOARD
15
BATTERY 16

BUOY ANTENNA SYSTEM

BACKGROUND OF THE INVENTION

This invention relates to an antenna system that may be used to transmit preset messages. More particularly, the present invention relates to an antenna system to be used with a marker buoy.

Buoys of various types that are used for communication purposes are well known. These buoys can be used to provide a submarine commander with a method for maintaining continuity of communication without having to surface or divert from his mode of operation.

Presently, electronic marker buoys may employ whip antennas that are mounted atop metal cased buoys for transmission of messages. These antennas are connected to electronic transmitters which are interior to the buoys. Hence, water-type seals are required for the antenna connections.

In many applications the antenna is not deployed nor extended until the buoy is afloat. To erect the antenna requires an automatic mechanism to be used.

In the above prior art buoy it would be desirable to eliminate the need for water-tight seals and for automatic extension mechanisms. By eliminating these needs, both the cost and malfunctions of such buoys would be reduced.

A need exists to provide an antenna system suitable for use in electronic buoys that is interior to the buoy housing.

SUMMARY OF THE INVENTION

Accordingly, it is an object of this invention to provide a buoy antenna system that does not require a water-tight seal between the antenna and the buoy housing.

It is another object of this invention to provide a buoy antenna system that does not require components to be extended beyond the interior of the buoy housing.

It is another object of this invention to provide a buoy antenna system that will reduce the cost of buoys used for electronic communication.

It is still another object of this invention to provide a buoy antenna system that will reduce the malfunctions of buoys used for electronic communication.

The buoy antenna system structure of the invention is suitable for providing transmission of communication signals generated within an expendable marker buoy. Moreover, the antenna structure is interiorly disposed within the buoy housing and eliminates costly antenna seals and automatic extension mechanisms. The buoy antenna system comprises a top loaded monopole antenna attached to a ground plane skirt. The antenna and ground plane skirt is disposed interiorly within a plastic housing that comprises the buoy outer shell in such a manner that the housing provides a dielectric medium through which the ground plane skirt is capacitively coupled to the sea water in which the buoy functions. Thus, the water surface becomes the ground plane for the antenna.

Various other objects and advantages will appear from the following description of the embodiment of the invention, and the novel features will be particularly pointed out hereinafter with the appended claims.

BRIEF DESCRIPTION OF THE DRAWING

The single FIGURE is a pictorial cut-away illustration of a buoy showing an antenna system in relationship to other electronic components.

DESCRIPTION OF THE PREFERRED EMBODIMENT

Referring to the FIGURE, a spar buoy is illustrated that comprises a molded plastic housing 14 containing monopole antenna 11. As will be explained later, the ground plane for antenna 11 is provided by water surface 17. Antenna 11 is top loaded by a capacitive or inductive spiral hat 12 and is completely encased by waterproof housing 14 thus avoiding leakage problems associated with buoy antennas which are usually affixed outside and atop of the buoy. However, plastic housing 14 prevents the usual direct contact of the antenna ground system with water surface 17 that is afforded by metal cased buoys wherein the antenna is excited with reference to the metal case. Therefore, antenna 11 is attached to ground plane skirt 13 which establishes a good RF connection between skirt 13 and water surface 17 by virtue of the capacitance between the skirt and the water surface. Thus, the water surface becomes a ground plane for the antenna.

Printed circuit (PC) board 15 contains electronic component parts for a transmitter connected in the usual well known manner to antenna 11. The power supply for PC board 15 is battery 16.

Details of the buoy antenna system illustrated by the FIGURE, as exemplified with a 350 MHz transmitter mounted on PC board 15 will now be discussed. Molded plastic housing 14 is made of fiberglass filled polycarbonate, is approximately 175 mils thick, 12 inches high, and has maximum and minimum diameters of approximately 3 inches and 1 inch, respectively. A spar buoy design was chosen because of the advantage in stability characteristics. The unit has a center of gravity below the center of buoyancy and is quite stable both while floating on water surface 17 and during the ascent phase. This plastic material provides a suitable dielectric for the necessary capacitance between ground plane skirt 13 and water surface 17, and constitutes a rugged housing that will withstand a large external pressure.

The inductive spiral hat 12 is approximately 2¼ inches above the top of ground plane skirt 13 and fits snugly against the inner surface of housing 14. Ground plane skirt 13 is made of 3 to 4 mil thick beryllium copper, and extends both above and below the water surface 17, for example, in the present invention approximately one inch above and three inches below, thereof.

Antenna 11 consists of a standard 50 ohm rigid coaxial cable such as type UT-141ASP made by Uniform Tubes Company. The inner conductor at the top of antenna cable 11 is attached to the inductive spiral conductor of hat 12, which is a printed circuit board with an inductive spiral pattern designed to provide the desired top loading for antenna 11. The top of the outer conductor of antenna cable 11 ends approximately ¼ inch below hat 12 in order to produce an effective driving source for the antenna at this point, as described later.

Antenna cable 11, positioned along the axis of the buoy, passes through a hole in the top surface of skirt 13 at which point the skirt is soldered to the outer conductor cable 11 thus providing the necessary electrical connection. At the lower end of antenna cable 11, interior of skirt 13, the inner conductor is attached to the transmitter RF output signal terminal on PC board 15 and the outer conductor is attached to the transmitter circuit ground terminal of PC board 15.

For the configuration described above, the capacitance between ground plane skirt 13 and water 17 is approximately 40 picofarads, which provides the desired RF connection to the water at the transmitter output signal frequency of 350 MHz. With the RF output power of the transmitter at 300 milliwatts at 350 MHz, the buoy antenna system has a typical range of 20 nautical miles with a standard AN/ARC-143 communications set receiving from an aircraft at 5000 feet altitude.

A top loaded grounded monopole antenna has been described which has its driving source, in effect, connected in series therewith at the point where the outer conductor of the antenna coaxial cable ends, approximately ¼ inch below hat 12 and approximately 2 inches above ground plane skirt 13. The interior of the antenna coaxial cable, between the driving source point and the transmitter output signal terminal on PC board 15, constitutes a length of 50 ohm transmission line. The purpose of arranging the driving source in series with monopole antenna 11 at a distance of approximately 2 inches from ground plane skirt 13 is to obtain a resonant impedance approximately matching the 50 ohm characteristic impedance of the transmission line formed by the coaxial cable. This impedance matching method for designing efficient antennas is well known in the antenna art.

Ground plane skirt 13 may function by capacitance to the water as described above, or the length of skirt 13, below the water surface, may be made to correspond to an odd number of quarter wavelengths of the RF signal in the transmission line formed by water surface 17, housing dielectric 14 and skirt 13. In this latter case the portion of skirt 13 below the water surface functions as an open ended quarter wavelength transmission line presenting an effective short circuit to the water and thereby effecting the desired ground plane connection.

The above described buoy antenna system is simple and inexpensive. It can be used with any RF transmitter or receiver where frequency and size make a grounded monopole antenna feasible.

The antenna system can be used in place of many buoy whip antennas in which case the expense of a water-tight seal is avoided; also the possibility of a malfunction caused by a faulty antenna seal is avoided. In many instances, these whip antennas cannot be extended beyond the buoy housing until the buoy is afloat because of storage space restrictions and other mechanical interference problems. This requires an additional automatic mechanism for erecting the antenna.

Thus, this invention also avoids the expense of such a mechanism as well as avoiding its potential malfunction.

The foregoing description of the embodiment of the invention is by way of example only and not intended to limit the scope of the appended claims. No attempt has been made to illustrate all possible embodiments of the invention but rather only to illustrate its principles and the best manner presently known to practice it. Therefore, such other forms of the invention as may occur to one skilled in the art upon reading of the foregoing specification are also within the spirit and scope of the invention and it is intended that this invention includes all modifications and equivalents which fall within the scope of the appended claims.

What is claimed is:

1. A buoy antenna system comprising in combination:

molded dielectric housing means having a predetermined center of buoyancy whereby a first portion of said housing means rides above a water surface and a second portion thereof rides submerged;

rigid antenna means mounted within said molded dielectric housing means for providing at least one function of a signal transmitting and receiving operation, said antenna means being disposed within said first portion of said molded dielectric housing means; conductive skirt means contiguously disposed within said molded dielectric housing means so that said conductive skirt means has a portion thereof which extends above said water surface with the remainder of said conductive skirt means extending below said water surface an odd multiple of quarter-wave lengths at the frequency of said transmitted signal, said conductive skirt means being attached to said antenna means; and transmitter means disposed within said molded dielectric housing means for providing signals to be transmitted by said antenna means, said transmitter means being electrically coupled to said antenna means.

2. The buoy antenna system of claim 1, wherein said capacitive skirt means and said molded dielectric housing means forms a capacitive structure with said water surface so that said water surface becomes the effective ground plane for said rigid antenna means.

3. The buoy antenna system of claim 2, wherein:

said transmitter means is disposed interiorly to said conductive skirt means; and said rigid antenna means include a top-loaded monopole antenna.

4. The buoy antenna system of claim 2, wherein:

said transmitter means is disposed interiorly to said conductive skirt means; and said rigid antenna means includes a top-loaded monopole antenna.

* * * * *